US005839264A

United States Patent [19]

Uchio

[11] Patent Number: 5,839,264

[45] Date of Patent: Nov. 24, 1998

[54] STEEL CORD FOR REINFORCEMENT OF OFF-ROAD TIRE

[75] Inventor: Takeshi Uchio, Tokyo, Japan

[73] Assignee: Tokyo Rope Manufacturing Co., Tokyo, Japan

[21] Appl. No.: 748,389

[22] Filed: Nov. 13, 1996

[30] Foreign Application Priority Data

Jan. 29, 1996 [JP] Japan ..... 8-034336

[51] Int. Cl.[6] ..... D02G 3/02; D02G 3/36

[52] U.S. Cl. ..... 57/237; 57/902

[58] Field of Search ..... 57/200, 211, 213, 57/214, 218, 231, 232, 237, 902, 12–15

[56] References Cited

U.S. PATENT DOCUMENTS 3,762,145 10/1973 Kikuchi et al. ..... 57/218

4,828,001 5/1989 Takahira ..... 57/902 X 5,605,036 2/1997 Onuma et al. ..... 57/218 X

FOREIGN PATENT DOCUMENTS 10151 3/1985 Japan ..... 57/213

*Primary Examiner*—Daniel P. Stodola
*Assistant Examiner*—Tina R. Taylor
*Attorney, Agent, or Firm*—Michael J. Striker

[57] ABSTRACT

The steel cord for reinforcement of an off-road tire has a superior resistance to penetration and durability with respect to sharp objects. It has a 3×3, a 3×4, a 4×3 or a 4×4 structure, an identical cord diameter at all points along the steel cord in a longitudinal direction, a cord lay length equal to from 3.5 to 7.5 times the cord diameter and an elongation at break of at least 4%. The steel cord is made up of element wires, each having a wire diameter of from 0.3 to 0.5 mm and a tensile strength of from 2000 to 3300 MPa.

2 Claims, 1 Drawing Sheet

STEEL CORD FOR REINFORCEMENT OF OFF-ROAD TIRE

BACKGROUND OF THE INVENTION

This invention relates to a steel cord for rubber reinforcement, and particularly to a steel cord for reinforcement of an off-road tire.

Large off-road vehicles, for example dump cars and wheel loaders for carrying ores at surface mines, are fitted with extremely large tires exceeding 3 m in diameter to raise their allowable loads. In the belt layers of these large tires, conventionally, steel cords of 7×7 structure and steel cords of 4×2 structure or 3×7 structure having high elongation have generally been used.

However, sites where these tires are used are rough, rocks become exposed at the ground surface and in extremely cold forest regions the ground surface freezes and sharp pieces of frozen wood are scattered on the ground, and thus the conditions in which the tires are used are extremely severe. Therefore, as the tire cord used in the belt layers, one having good durability whose characteristic of not being cut by rocks and frozen pieces of wood (anti-stone penetration performance) is excellent and whose resistance to shearing dynamic impact is good is called for, but with the steel cords mentioned above these characteristics have been unsatisfactory.

As a solution to this, using a large-diameter steel cord of 7×7×0.25 mm structure or the like in belt layers of off-road tires and using this steel cord together with a high elongation steel cord of a 4×2×0.35 mm structure or a 3×7×0.22 mm structure have been being tried.

However, with steel cords of 7×7×0.25 mm structure or 3×7×0.22 mm structure, because the diameter of the element wires used is small, when they are used in a belt layer the element wires are easily cut when rocks or pieces of wood pierce the tire, element wire breakage propagates through the steel cord and this often soon leads to early breakage of the steel cord or early bursting of the tire, and thus there has been a problem of unsatisfactory anti-stone penetration performance.

In a steel cord of 4×2×0.35 mm structure, on the other hand, as shown in FIG. 5-A, FIG. 5-B and FIG. 5-C, the shape of the steel cord in a cross-section orthogonal to the length direction of the cord is different at different positions in the cord length direction. Consequently the shape is nonuniform and the cord does not function as an integrated member. As a result, there are parts of the steel cord whose anti-stone penetration performance is inferior and a stable anti-stone penetration performance is not obtained. Consequently, as with conventional steel cords, there has been the problem that early breakage of the steel cord and early bursting of the tire tend to occur.

SUMMARY OF THE INVENTION

The present invention was devised to solve this kind of problem, and an object of the invention is to provide a steel cord for reinforcement of an off-road tire whose resistance to shearing dynamic impact and anti-stone penetration performance are good and which is superior particularly in its resistance to penetration and durability with respect to sharp objects existing at the ground surface such as rocks and pieces of wood.

Besides being ideal as a reinforcing material of radial tires of vehicles for carrying ores, the steel cord of the invention can also be used as a reinforcing material of tires of vehicles for carrying timber and large vehicles for road construction work such as load graders, earth movers, scrapers and wagon shovels.

To achieve the above-mentioned object and other objects, the invention provides a steel cord for reinforcement of an off-road tire having a 3×3, a 3×4, a 4×3 or a 4×4 structure and made up of element wires each of diameter 0.3 to 0.5 mm and of a tensile strength after the cord is taken apart of about 2000 to 3300 MPa, the lay length of the steel cord being 3.5 to 7.5 times the steel cord diameter.

Preferably, the element wires are each of diameter 0.32 to 0.45 mm and of a tensile strength after the cord is taken apart of 2100 to 3300 MPa. Also, the elongation at break of the steel cord is preferably at least 4%.

The steel cord of the invention is generally used in a belt layer below the tread rubber of a tire, and when there are a plurality of such belt layers is used in at least the outermost belt layer.

With this kind of construction, the twist structure of the steel cord is stable and the cross-section orthogonal to the length direction of the cord has the same shape at any position along the cord and the cord functions as an integrated member. Furthermore, by the element wires making up the steel cord being made thick in diameter within a fixed range and by the ratio of the cord lay length to the cord diameter being set within a prescribed range a high elongation is obtained. Due to a synergistic effect of these features, anti-stone penetration performance and durability with respect to sharp objects, such as rocks and pieces of wood are increased. By using this kind of steel cord in at least the outermost belt layer it is possible to markedly improve the durability of a large radial off-road tire.

Specific representative details and preferred embodiments of the invention are described below, but it will be apparent to a person skilled in the art that various changes and modifications can be made to these details and preferred embodiments without deviating from the concept or the scope of the invention.

BRIEF DESCRIPTION OF THE DRAWINGS

FIG. 1-A is a sectional view schematically showing the steel cord of the first version cut at a different location in the length direction;

FIG. 2-A is a sectional view schematically showing the second version cut at a different location in the cord length direction;

FIG. 3-A is a sectional view schematically showing the third version cut at a different location in the cord length direction;

FIG. 5-A, FIG. 5-B and FIG. 5-C are sectional views showing change in cross-sectional shape in the cord length direction of a conventional steel cord.

DETAILED DESCRIPTION OF THE PREFERRED EMBODIMENTS

First, the steel cord of the invention has one of the forms 3×3, 3×4, 4×3 and 4×4.

Figure 1:
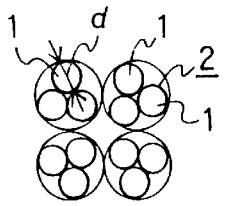
FIG. 1 is a sectional view schematically showing a first version of a steel cord according to the invention.
Figure 1:
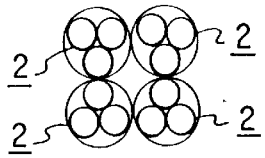

FIG. 1 shows a 4×3 structure (first version) made by twisting together three element wires 1, 1, 1 into one strand 2 and then twisting together four of these strands 2. FIG. 1-A shows a cross-section at a different location in the length direction; the cross-sectional shape of the cord is the same.

Figure 2:
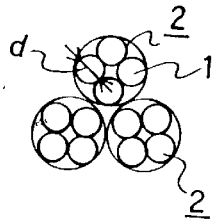
FIG. 2 is a sectional view schematically showing a second version of a steel cord according to the invention.
Figure 2:
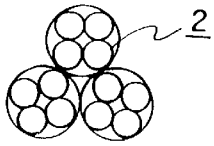

FIG. 2 shows a 3×4 structure (second version) made by twisting together four element wires 1, 1, 1, 1 into a strand 2 and then twisting together three of these strands 2. As is clear from FIG. 2-A, even at a different location in the length direction, the cross-sectional shape of the cord is the same.

Figure 3:
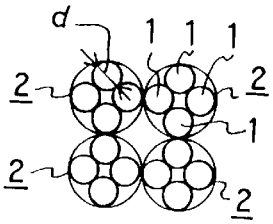
FIG. 3 is a sectional view schematically showing a third version of a steel cord according to the invention.
Figure 3:
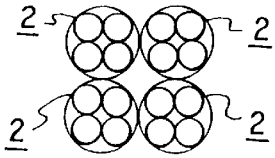

FIG. 3 shows a 4×4 structure (third version) made by twisting together four element wires 1, 1, 1, 1 into a strand 2 and then twisting together four of these strands 2. In this case also, as shown in FIG. 3-A, even at a different location in the length direction the cross-sectional shape of the cord is the same.

With the cord structures of the invention, because the cross-section of the steel cord is the same at all points in the length direction of the steel cord, the shape is stable and furthermore the whole steel cord is compact and functions as an integrated member. Consequently, the resistance to shearing dynamic impact is markedly high. Also, because the shape of the steel cord is stable in the length direction, an anti-stone penetration performance stable over the entire length of the steel cord is obtained.

Also, in the invention, in the first through third versions described above and a 3×3 cord structure not shown in the drawings, the following conditions are employed:

1) The wire diameter of each element wire 1 is made 0.30 to 0.50 mm.
2) The tensile strength of each element wire after the cord is taken apart is made about 2000 to 3300 MPa.
3) The lay length of the steel cord is made 3.5 to 7.5 times the steel cord diameter.

Explaining the reasons for employing these conditions, first, the reason for making the lower limit of the wire diameter of the element wire 1 0.30 mm is that a wire diameter d of less than 0.30 mm is unsuitable because the strength of the steel cord is inadequate for reinforcement and element wire broken surfaces tend to arise. The reason for making the upper limit of the wire diameter of the element wire 1 0.50 mm is that when the wire diameter of the element wire 1 exceeds 0.50 mm the cord diameter becomes large and the rigidity of the cord becomes too high and also a belt layer in which the steel cord is embedded becomes thick. In this invention, the most preferable wire diameter range is 0.32 to 0.45 mm.

As a result of the wire diameter being made large within the above-mentioned prescribed range in this way the element wires 1 do not readily break even when rocks or pieces of wood pierce the tire, and the phenomenon of propagation of element wire breakage does not readily occur. The element wires do not all have to be of the same diameter, and may be different within the above-mentioned range.

Next, the reason for stipulating the tensile strength of the element wires is to secure strength and toughness, and the reason for making the standard of this tensile strength of the element wires not the tensile strength of a single element wire before being twisted into a strand and then twisted into a cord but rather the 'tensile strength after the cord is taken apart' is that because the element wires undergo bending as a result of being twisted together their strength decreases, and particularly because the shorter the pitch at which they are twisted together the lower the twisting efficiency becomes, stipulating the tensile strength of the element wires before they are twisted together cannot be said to be consistent with reality.

When the tensile strength of a removed element wire after the cord is taken apart is less than about 2000 MPa the strength is inadequate, and exceeding 3300 MPa is also unsuitable because the wire becomes brittle due to decrease in toughness. About 2000 MPa means a tensile strength exceeding 1950 MPa. The most preferable range is 2100 to 3100 MPa.

Also, in the invention, the lay length P of the steel cord is made small in relation to the cord diameter D. This is to secure an elongation at break of the steel cord of at least 4% and raise resistance to shearing dynamic impact and improve resistance to penetration by rocks and pieces of wood. Here, the steel cord diameter means the circumscribed circle diameter of the steel cord, and a lay length P of the steel cord of less than 3.5 times the steel cord diameter D is unsuitable because the percentage strength utilization of the element wires falls and a lay length exceeding 7.5 times the steel cord diameter is also unsuitable because the elongation at break of the steel cord becomes too small. A preferable range of the ratio of the lay length P of the steel cord to the steel cord diameter D is 3.5 to 7.0.

The twisting direction of the strands 2 and the twisting direction of the steel cord are the same direction (SS or ZZ).

By satisfying the conditions 1), 2) and 3) set forth above it is possible to increase the anti-stone penetration performance and durability of the steel cord without sacrificing strength or toughness by means of a synergistic effect of these conditions combined with the steel cord structure.

The elongation at break of the steel cord must be at least 4%. This is because with an elongation at break less than this the impact absorption energy is too small and the anti-stone penetration performance deteriorates. A steel cord according to the invention can also satisfy this condition.

In all the versions mentioned above, like an ordinary element wire the element wire 1 consists of high carbon steel and has its surface coated with a surface coating such as brass plating to improve its adhesion to a rubber matrix.

EXAMPLES

Preferred embodiments of the invention will now be shown, together with comparison examples and conventional examples.

Samples 1 to 13 in Table 1 are preferred embodiments of a steel cord of the first version of the invention. Sample 14 of Table 1 is a comparison example, and Samples 15 to 17 are conventional examples. The element wire diameter 0.25+0.15 of Sample 15 means that strands were made using element wires of diameter 0.25 mm and with these strands twisted together one element wire of diameter 0.15 mm was wound around them in a spiral.

Samples 18 to 27 and Samples 29 and 30 of Table 2 are preferred embodiments of a steel cord of the second version of the invention, and Sample 28 of Table 2 is a comparison example.

Samples 32 to 37 and 39 to 44 of Table 3 are preferred embodiments of a steel cord of the third version of the invention. Samples 31 and 38 in Table 3 are comparison examples.

Figure 4:
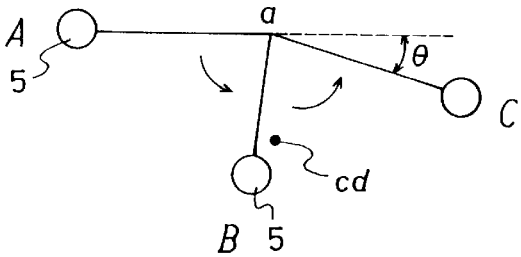
FIG. 4 is a view schematically illustrating a method for testing resistance to shearing dynamic impact in the invention.
Figure 4:
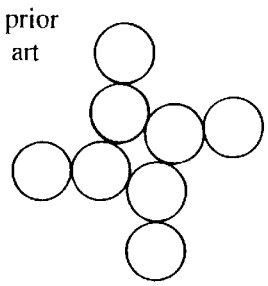
Figure 4:
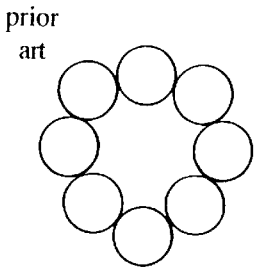
Figure 4:
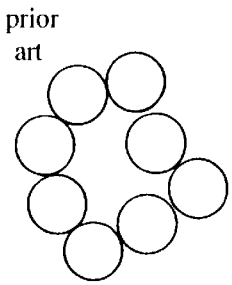

In Table 1 through Table 3, the 'resistance to shearing dynamic impact' is a value measured using a Charpy impact tester and adopting a method wherein as shown schematically in FIG. 4 a weight 5 is dropped like a pendulum about a point 'a' from a predetermined position A and breaks a sample cord cd attached in a predetermined position B by shearing and the position to which it swings up in pendulum motion is detected, and is a value obtained by measuring the angle θ formed by an extension line from the position A and the position C to which the weight 5 swings up and using this to calculate a shearing dynamic impact absorption energy.

The 'resistance to shearing dynamic impact index' in Table 1 through Table 3 is a value obtained by converting the shearing dynamic impact absorption energy measured by the test method described above into a per unit mass value and expressing this with the shearing dynamic impact absorption energy per unit mass of Sample 17 (a conventional steel cord of 4×2×0.35 mm structure) taken as 100.

The 'repeat resistance to shearing dynamic impact' means the anti-stone penetration performance, and is a value obtained similarly using a Charpy impact tester by a method wherein a weight of a predetermined weight and having a wedge-shaped leading edge is swung down from the position A and the number of drop repetitions until the cord breaks is recorded and expressing this as an index with the value (the number of drops until breaking) per unit mass of the Sample 17 taken as 100.

As is clear from Table 1 through Table 3, in the conventional steel cord of 7×7×0.25+0.15 structure of Sample 15 the element wire diameter is small and the ratio (P/D) of the cord lay length to the cord diameter is excessive and the elongation at break is low. Consequently, although the resistance to shearing dynamic impact per single steel cord is good, the resistance to shearing dynamic impact and repeat resistance to shearing dynamic impact per unit mass are greatly inferior. Also, because the cord diameter is large the number of cords embedded in rubber for a belt layer becomes small and the resistance to shearing dynamic impact when used in an off-road tire is inferior. In Sample 15 an element wire of diameter 0.15 mm is wrapped around the twisted-together strands.

In the conventional example of Sample 16 (3×7×0.22 mm structure), because the element wire diameter is small, the resistance to shearing dynamic impact per single cord and the resistance to shearing dynamic impact and repeat resistance to shearing dynamic impact per unit mass are greatly inferior.

In Samples 1 to 13, 18 to 27, 29, 30, 32 to 37 and 39 to 44, which are preferred embodiments of the invention, because the structure of the steel cord, the element wire diameter and the ratio (P/D) of the cord lay length to the cord diameter are each in an optimum range, the elongation, the resistance to shearing dynamic impact per single cord and the resistance to shearing dynamic impact and the repeat resistance to shearing dynamic impact per unit mass were all good. In particular, Samples 1 to 12, 18 to 27, 30, 33 to 37 and 39 to 44, of which the element wire diameter was 0.32 to 0.45 mm, the tensile strength of the element wires after the cord is taken apart was 2100 to 3300 MPa and the cord lay length was in the range 3.5 to 7.0 times the cord diameter, showed excellent characteristics.

In the comparison example of Sample 14, because the element wire diameter is too large, the resistance to shearing dynamic impact is inferior. In the comparison example of Sample 16, because the relationship (P/D) between the cord diameter and the lay length is unsuitable, the resistance to shearing dynamic impact again is inferior. In the comparison example of Sample 31, because the element wire diameter is too small, the breaking strength is inferior. In the comparison example of Sample 38, because the relationship (P/D) between the cord diameter and the lay length is unsuitable, the anti-stone penetration performance is inferior.

TABLE 1

| Sample | Structure | Element wire diameter (mmϕ) | Cord diameter D (mmϕ) | P/D | Element wire tensile strength (MPa) | Breaking load (N) | Elongation at break (%) | Resistance to shearing dynamic impact index | Repeat resistance to shearing dynamic impact index |
|---|---|---|---|---|---|---|---|---|---|
| 1 | 3 × 4 | 0.32 | 1.74 | 4.5 | 2885 | 2190 | 7.0 | 126 | 145 |
| 2 | 3 × 4 | 0.32 | 1.73 | 5.5 | 2950 | 2350 | 6.0 | 131 | 150 |
| 3 | 3 × 4 | 0.32 | 1.72 | 6.5 | 3020 | 2480 | 5.0 | 130 | 149 |
| 4 | 3 × 4 | 0.35 | 1.90 | 4.5 | 2560 | 2380 | 7.0 | 126 | 150 |
| 5 | 3 × 4 | 0.35 | 1.89 | 5.5 | 2620 | 2480 | 6.0 | 127 | 153 |
| 6 | 3 × 4 | 0.35 | 1.88 | 6.5 | 2650 | 2610 | 5.0 | 125 | 151 |
| 7 | 3 × 4 | 0.35 | 1.89 | 5.5 | 2295 | 2210 | 6.0 | 113 | 136 |
| 8 | 3 × 4 | 0.35 | 1.89 | 5.5 | 2865 | 2730 | 6.0 | 140 | 168 |
| 9 | 3 × 4 | 0.40 | 2.18 | 4.5 | 2155 | 2660 | 7.0 | 122 | 157 |
| 10 | 3 × 4 | 0.40 | 2.16 | 5.5 | 2205 | 2770 | 6.0 | 124 | 159 |
| 11 | 3 × 4 | 0.40 | 2.15 | 6.5 | 2230 | 2880 | 5.0 | 121 | 155 |
| 12 | 3 × 4 | 0.45 | 2.43 | 6.0 | 2140 | 3450 | 5.5 | 134 | 183 |
| 13 | 3 × 4 | 0.50 | 2.73 | 4.5 | 1980 | 3820 | 7.0 | 101 | 145 |
| 14 | 3 × 4 | 0.55 | 2.97 | 5.5 | 1940 | 4610 | 6.0 | 93 | 141 |
| 15 | 7 × 7 | 0.25 + 0.15 | 2.25 | 8.7 | 3140 | 6700 | 2.0 | 72 | 73 |
| 16 | 3 × 7 | 0.22 | 1.52 | 5.2 | 2500 | 1820 | 7.0 | 91 | 87 |
| 17 | 4 × 2 | 0.35 | 1.62 | 6.2 | 2260 | 1390 | 5.0 | 100 | 100 |

Note: P/D = cord lay lentth/cord diameter

TABLE 2

| Sample | Structure | Element wire diameter (mmϕ) | Cord diameter D (mmϕ) | P/D | Element wire tensile strength (MPa) | Breaking load (N) | Elongation at break (%) | Resistance to shearing dynamic impact index | Repeat resistance to shearing dynamic impact index |
|---|---|---|---|---|---|---|---|---|---|
| 18 | 4 × 3 | 0.32 | 1.74 | 4.5 | 2885 | 2190 | 7.0 | 126 | 145 |
| 19 | 4 × 3 | 0.32 | 1.73 | 5.5 | 2950 | 2350 | 6.0 | 131 | 150 |
| 20 | 4 × 3 | 0.32 | 1.72 | 6.5 | 3020 | 2480 | 5.0 | 130 | 149 |
| 21 | 4 × 3 | 0.35 | 1.90 | 4.5 | 2560 | 2380 | 7.0 | 126 | 150 |
| 22 | 4 × 3 | 0.35 | 1.89 | 5.5 | 2620 | 2480 | 6.0 | 127 | 153 |
| 23 | 4 × 3 | 0.35 | 1.88 | 6.5 | 2650 | 2610 | 5.0 | 125 | 151 |
| 24 | 4 × 3 | 0.35 | 1.89 | 5.5 | 2295 | 2210 | 6.0 | 113 | 136 |
| 25 | 4 × 3 | 0.35 | 1.89 | 5.5 | 2865 | 2730 | 6.0 | 140 | 168 |
| 26 | 4 × 3 | 0.40 | 2.18 | 4.5 | 2155 | 2660 | 7.0 | 122 | 157 |
| 27 | 4 × 3 | 0.40 | 2.16 | 5.5 | 2205 | 2770 | 6.0 | 124 | 159 |
| 28 | 4 × 3 | 0.40 | 2.14 | 8.0 | 2280 | 3030 | 3.8 | 99 | 154 |
| 29 | 4 × 3 | 0.40 | 2.15 | 7.5 | 2255 | 2950 | 4.2 | 101 | 129 |
| 30 | 4 × 3 | 0.40 | 2.15 | 6.5 | 2230 | 2880 | 5.0 | 121 | 155 |

Note: P/D = cord lay lentth/cord diameter

TABLE 3

| Sample | Structure | Element wire diameter (mmϕ) | Cord diameter D (mmϕ) | P/D | Element wire tensile strength (MPa) | Breaking load (N) | Elongation at break (%) | Resistance to shearing dynamic impact index | Repeat resistance to shearing dynamic impact index |
|---|---|---|---|---|---|---|---|---|---|
| 31 | 4 × 4 | 0.28 | 1.72 | 4.5 | 2925 | 2260 | 7.0 | 97 | 86 |
| 32 | 4 × 4 | 0.30 | 1.87 | 3.5 | 2855 | 2400 | 7.5 | 105 | 117 |
| 33 | 4 × 4 | 0.32 | 1.96 | 4.5 | 2885 | 2920 | 7.0 | 125 | 143 |
| 34 | 4 × 4 | 0.32 | 1.94 | 5.5 | 2950 | 3140 | 6.0 | 130 | 150 |
| 35 | 4 × 4 | 0.32 | 1.94 | 6.5 | 3020 | 3310 | 5.0 | 130 | 149 |
| 36 | 4 × 4 | 0.35 | 2.14 | 4.5 | 2560 | 3170 | 7.0 | 124 | 148 |
| 37 | 4 × 4 | 0.35 | 2.13 | 5.5 | 2620 | 3310 | 6.0 | 126 | 151 |
| 38 | 4 × 4 | 0.35 | 2.21 | 3.0 | 2440 | 2940 | 8.0 | 107 | 97 |
| 39 | 4 × 4 | 0.35 | 2.12 | 6.5 | 2650 | 3490 | 5.0 | 125 | 149 |
| 40 | 4 × 4 | 0.35 | 2.13 | 5.5 | 2295 | 2940 | 6.0 | 112 | 134 |
| 41 | 4 × 4 | 0.35 | 2.13 | 5.5 | 2865 | 3640 | 6.0 | 138 | 166 |
| 42 | 4 × 4 | 0.40 | 2.45 | 4.5 | 2155 | 3550 | 7.0 | 121 | 155 |
| 43 | 4 × 4 | 0.40 | 2.43 | 5.5 | 2205 | 3700 | 6.0 | 123 | 158 |
| 44 | 4 × 4 | 0.40 | 2.42 | 6.5 | 2230 | 3840 | 5.0 | 120 | 154 |

Note: P/D = cord lay lentth/cord diameter

What is claimed is:

1. A steel cord for reinforcement of an off-road tire, said off-road tire comprising at least one belt layer including an outermost belt layer and at least said outermost belt layer comprising said steel cord, wherein said steel cord has a 3×3, a 3×4, a 4×3 or a 4×4 structure, said steel cord has an identical cord diameter at all points along the steel cord in a longitudinal direction, said steel cord has a cord lay length equal to from 3.5 to 7.5 times said cord diameter and said steel cord has an elongation at break of at least 4%, and wherein said steel cord comprises a plurality of element wires according to said structure, each of the element wires have a wire diameter of from 0.3 to 0.5 mm and a tensile strength of from 2000 to 3300 MPa, said tensile strength being determined by taking apart said steel cord, removing an individual one of the element wires and subsequently measuring said tensile strength of said individual one of the element wires after the removing.

2. The steel cord as defined in claim 1, wherein said wire diameter is from 0.32 to 0.45 mm, said tensile strength is from 2100 to 3300 MPa and said cord lay length is from 3.5 to 7.0 times said cord diameter.

* * * * *